US010612729B2

(12) United States Patent
Bittmann et al.

(10) Patent No.: US 10,612,729 B2
(45) Date of Patent: Apr. 7, 2020

(54) DRIVER FIXATION WITH CEMENT FOR LED TUBES

(71) Applicant: LEDVANCE GmbH, Garching bei Munchen (DE)

(72) Inventors: Thomas Bittmann, Friedberg (DE); Klaus Eckert, Herbrechtingen (DE); Patrick Kotal, Regenstauf (DE); Bernd Pilhoefer, Graben (DE); Florian Wagner, Regensburg (DE)

(73) Assignee: LEDVANCE GMBH, Garching Bei Munchen (DE)

( * ) Notice: Subject to any disclaimer, the term of this patent is extended or adjusted under 35 U.S.C. 154(b) by 0 days.

(21) Appl. No.: 16/176,650

(22) Filed: Oct. 31, 2018

(65) Prior Publication Data

US 2019/0145586 A1 May 16, 2019

(30) Foreign Application Priority Data

Nov. 10, 2017 (DE) ..... 10 2017 126 348

(51) Int. Cl.

| | |
|---|---|
| ***F21K 9/272*** | (2016.01) |
| ***F21V 23/00*** | (2015.01) |
| ***F21V 17/10*** | (2006.01) |
| ***F21V 15/015*** | (2006.01) |
| ***F21Y 115/10*** | (2016.01) |

(52) U.S. Cl.

CPC ..... *F21K 9/272* (2016.08); *F21V 15/015* (2013.01); *F21V 17/101* (2013.01); *F21V 23/004* (2013.01); *F21Y 2115/10* (2016.08)

(58) Field of Classification Search

CPC ..... F21K 9/272; F21V 15/015; F21V 17/101; F21V 23/004

USPC ..... 362/217.1

See application file for complete search history.

(56) References Cited

U.S. PATENT DOCUMENTS

| | | | | |
|---|---|---|---|---|
| 5,036,248 | A * | 7/1991 | McEwan | G09F 9/33 313/110 |
| 6,283,612 | B1 * | 9/2001 | Hunter | F21V 15/015 362/217.05 |
| 6,761,472 | B1 * | 7/2004 | Cleaver | F21S 4/20 362/219 |
| 7,503,673 | B2 * | 3/2009 | Chou | G02B 6/0043 362/223 |
| 9,139,682 | B2 * | 9/2015 | Linnenbrink | C08G 18/10 |
| 9,955,587 | B2 * | 4/2018 | Jiang | F21K 9/272 |
| 10,024,502 | B1 * | 7/2018 | Purdy | F21K 9/272 |
| 2010/0103673 | A1 * | 4/2010 | Ivey | B29C 39/10 362/249.02 |
| 2010/0201269 | A1 * | 8/2010 | Tzou | F21V 23/006 315/51 |

(Continued)

FOREIGN PATENT DOCUMENTS

| | | | |
|---|---|---|---|
| DE | 10024427 | A1 | 12/2001 |
| DE | 212015000210 | U1 | 4/2017 |

*Primary Examiner* — Bryon T Gyllstrom

(74) *Attorney, Agent, or Firm* — Hayes Soloway PC

(57) ABSTRACT

A light fixture and a method of making a light fixture include a light-permeable tube, at least one end cap pushed onto a free end of the tube for closure, and a driver device received at least partially in the tube and held in the tube by the end cap for driving a light module arranged in the tube. The end cap is fastened on the tube by an expanded adhesive and the driver device is fastened to the end cap or to the tube by the expanded adhesive.

17 Claims, 3 Drawing Sheets

(56) References Cited

U.S. PATENT DOCUMENTS

| | | | | |
|---|---|---|---|---|
| 2012/0106157 | A1* | 5/2012 | Simon | F21V 25/04<br>362/249.05 |
| 2014/0153231 | A1* | 6/2014 | Bittmann | F21K 9/23<br>362/217.14 |
| 2016/0091147 | A1* | 3/2016 | Jiang | F21V 3/061<br>315/205 |
| 2019/0137051 | A1* | 5/2019 | Bittmann | F21K 9/272 |

* cited by examiner

DRIVER FIXATION WITH CEMENT FOR LED TUBES

CROSS-REFERENCE TO RELATED APPLICATIONS AND PRIORITY

This patent application claims priority from German Patent Application No. 102017126348.9 filed Nov. 10, 2017, which is herein incorporated by reference in its entirety.

TECHNICAL FIELD

The present invention relates to a light fixture, for example a LED light fixture, a tube light or a LED tube light, and to a method for producing the light fixture.

BACKGROUND

Light fixtures are known which have a tube or a tubular housing, the ends of which are covered by end caps which are fitted thereon, wherein a light module is arranged inside the tube. In this case it is known to use end caps which have a base or end face and a cylindrical collar extending from the base. The end caps are usually connected to the tube by means of a heat-curing cement, which is applied to the inner face of a cylindrical collar of the end cap.

Furthermore, it is known to provide a driver device, which is arranged on an inner face of the end cap, for driving of the light module.

For fastening or fixing of the driver device to or inside the tube it is known to use a plastic end cap, the interior of which has a guide track into which the driver device can be inserted. For final fixing, the driver device is fixed with a spot of adhesive on the base of the end plate. Plastic end caps are complex and expensive to produce. Furthermore, the adhesive used for fixing the driver device is expensive.

Alternatively, it is known to use metallic end caps, in particular end caps made of aluminum. In this case the driver device is inserted by means of its connecting wires into base sleeves of the end cap and is fixed with a spot of adhesive. However, the driver device has no defined position and can become loose because of the small amount of adhesive and can knock against the inner wall of the tube. Furthermore, the adhesive system used is expensive.

SUMMARY

Starting from the known prior art, it is an object of the present invention to provide an improved light fixture as well as a corresponding method for production of a light fixture.

This object is achieved by a light fixture and a method for production of a light fixture with the features of the independent claims. Advantageous further embodiments are apparent from the subordinate claims, the description and the drawings.

Accordingly, a light fixture is proposed, comprising a light-permeable tube, at least one end cap pushed onto a free end of the tube for closure, a driver device received at least partially in the tube and held in the tube by the end cap for driving the light module, wherein the end cap is fastened on the tube by means of an expanded adhesive. According to the invention the driver device is fastened to the end cap and/or to the tube by means of the expanded adhesive.

The term "light-permeable" is understood here to mean a property for electromagnetic radiation emitted by the light module, in particular light emitted by the light module, in particular light in the visible spectrum, is at least partially transmissive with or without scattering. In particular the aforementioned term covers light-permeable, opaque tubes, and tubes which are provided with a coating to produce a light emission which is homogeneous to the human eye.

Because the driver device is fastened to the end cap and/or to the tube by means of the expanded adhesive, a simplified design and a simplified manufacture of the light fixture can be achieved. Since the driver device is fixed by the adhesive, it is possible to dispense with the expensive bonding adhesive, which is otherwise additionally necessary, for fixing the driver device on the end cap. Moreover, no guide tracks need to be produced, by a separate injection molding process, for holding the driver device. Furthermore, the end cap can be provided as a simple metal shaped part. Consequently, the production costs for the light fixture are lowered. Moreover, due to the expanded adhesive the driver device is reliably prevented from slipping or becoming loose in the tube. Moreover, fixing the driver device and connecting the end cap to the tube can take place by one single application of heat, and therefore in one manufacturing step.

According to a further preferred embodiment, the driver device is at least partially surrounded by the same cohesive application of expanded adhesive, which fastens the end cap on the tube, wherein the expanded adhesive preferably also extends into the tube. In other words, the adhesive expands out of the connection region or overlap region between the end cap and the tube, even into the interior of the light fixture, and in this case at least partially surrounds the driver device. In this way a foam cladding of the driver device is produced at least in the region of the end cap. The quantity of adhesive applied to a collar of the end cap is preferably chosen in such a way that after the expansion the adhesive also extends into the tube.

According to a further preferred embodiment, the adhesive is a foamed, preferably heat-cured cement. As a result, a particularly reliable connection and/or sealing of the end cap and the tube as well as particularly reliable fixing of the driver device can be achieved. Furthermore, the heat-curing cement only needs to have a small amount of heat to be applied in order to achieve foaming.

According to a further preferred embodiment, the expanded adhesive surrounds the driver device at least partially, wherein the expanded adhesive, preferably at least partially, fills a free space present between the tube and the driver device. As a result, a particularly reliable fixing of the driver device can be achieved.

According to a further preferred embodiment, the driver device is connected to contact pins extending outwards through the end cap for contacting a lamp socket and a light module driven by the driver device, preferably a LED light module, is preferably arranged inside the tube. As a result, a simple and sturdy construction of the light fixture can be achieved.

According to a further preferred embodiment, the light module is a LED module, preferably a LED chip. A plurality of light modules, in particular LED modules, preferably LED chips, is preferably received in the tube.

According to a further preferred embodiment, the light fixture is configured as a retrofit tube light for replacement of a conventional fluorescent tube.

The object stated above is achieved by a method for producing a light fixture with the features of the independent claim 6. Advantageous further embodiments are apparent from the subordinate claims, the description and the drawings.

Accordingly a method for producing a light fixture is proposed, comprising the following steps: providing a light-permeable tube, a driver device for driving a light module and an end cap for fitting onto a free end of the tube to close it; applying an expandable adhesive to the inner face of an annular overlap region of the end cap, by means of which the fitted end cap overlaps the tube; at least partially introducing the driver device into the tube and fitting the overlap region of the end cap onto the tube; expanding the adhesive for fastening the end cap on the tube. According to the invention the driver device is fastened to the end cap and/or to the tube by the adhesive during expansion of the adhesive.

According to a preferred embodiment of the method the driver device is at least partially surrounded, preferably covered with foam, and is thereby fastened to the end cap and/or to the tube. As a result, a particularly reliable fastening and fixing of the driver device can be achieved, without a separate method step being necessary for fastening the driver device to the end cap.

According to a further preferred embodiment, during the expansion the adhesive at least partially fills a free space present between the tube and the driver device. In this way the driver device is likewise fixed directly relative to the tube and thus is held particularly securely in its position.

According to a further preferred embodiment the expansion, preferably the foaming, of the adhesive is triggered by means of a heat input onto the adhesive. In this way the fixing of the driver device can be achieved in a particularly simple manner.

According to a further preferred embodiment, before the at least partial introduction of the driver device into the tube, the driver device is connected to contact pins extending outwards from the end cap for contacting a lamp socket, and preferably for connecting the driver device and the contact pins connecting wires of the driver device are introduced from an inner face of the end cap into hollow contact pins formed on the inner face and particularly preferably are then crimped.

According to a further preferred embodiment a foamed, preferably heat-curing cement is used as the adhesive.

BRIEF DESCRIPTION OF THE DRAWINGS

Preferred further embodiments of the invention are explained in greater detail by the following description of the drawings. In the drawings.

DETAILED DESCRIPTION OF THE DRAWINGS

Figure 1:
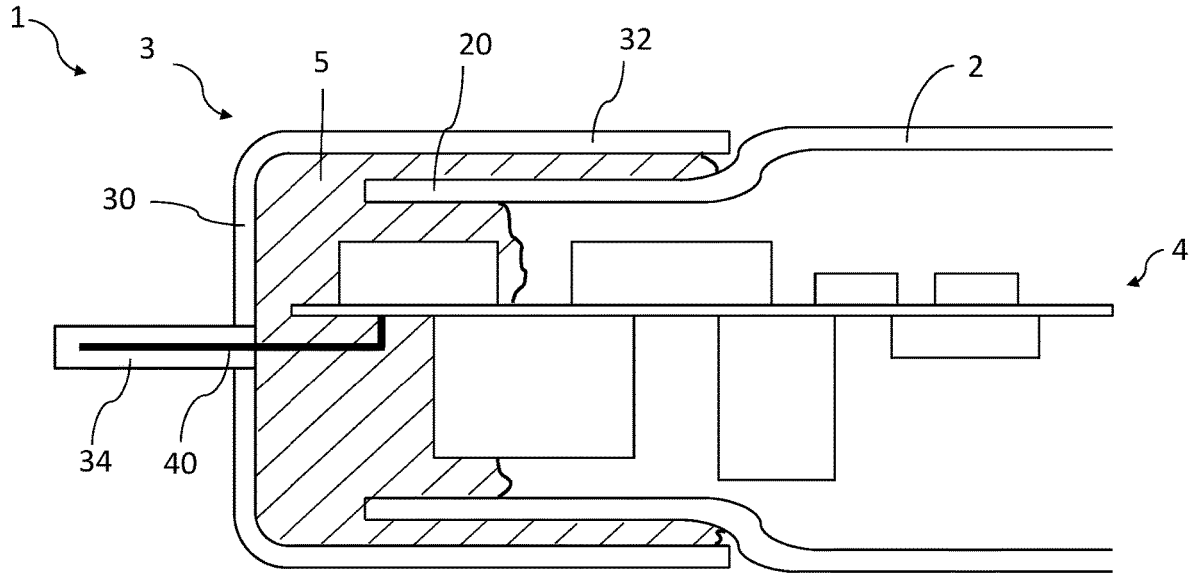
FIG. 1 shows schematically a perspective side view of a light fixture according to the invention.

Preferred exemplary embodiments are described below with reference to the drawings. In this case elements which are the same, similar, or act in the same way are provided with identical reference numerals in the different drawings, and repeated description of some of these elements is omitted in order to avoid redundancies.

A perspective side view of a light fixture 1 according to the invention is shown schematically in FIG. 1. The light fixture 1 comprises a light-permeable glass tube 2 and an end cap 3 made of aluminum fitted on a free end 20 of the tube 2. Therefore, the end cap 3 closes the free end 20 of the tube 2.

A light module (not shown) which is preferably designed in the form of a LED light module or LED chips is arranged inside the tube 2.

Furthermore, a driver device 4 for driving the light module is arranged on an inner face of the end cap 3, wherein the driver device 4 is connected to contact pins 34 extending from the end cap 3 to the outside for contacting of a contact means of a lamp socket and is introduced at least partially into the tube 2.

Furthermore, an expanded, in this case foamed adhesive 5 in the form of a heat-curing cement fastens the end cap 3 on the tube 2. Moreover, the driver device 4 is fixed relative to the end cap 3 and the tube 2 by means of the expanded, in this case foamed, adhesive 5.

In this case the adhesive 5 partially surrounds the driver device 4, wherein the foamed adhesive 5 partially fills a free space located between the tube 2 and the driver device 4.

An adhesive which is already known per se for connecting the end caps and the tubes, preferably an adhesive cement, can be used as the adhesive 5.

A method for producing the light fixture according to FIG. 1 is explained below with reference to FIGS. 2 and 3.

Figure 2:
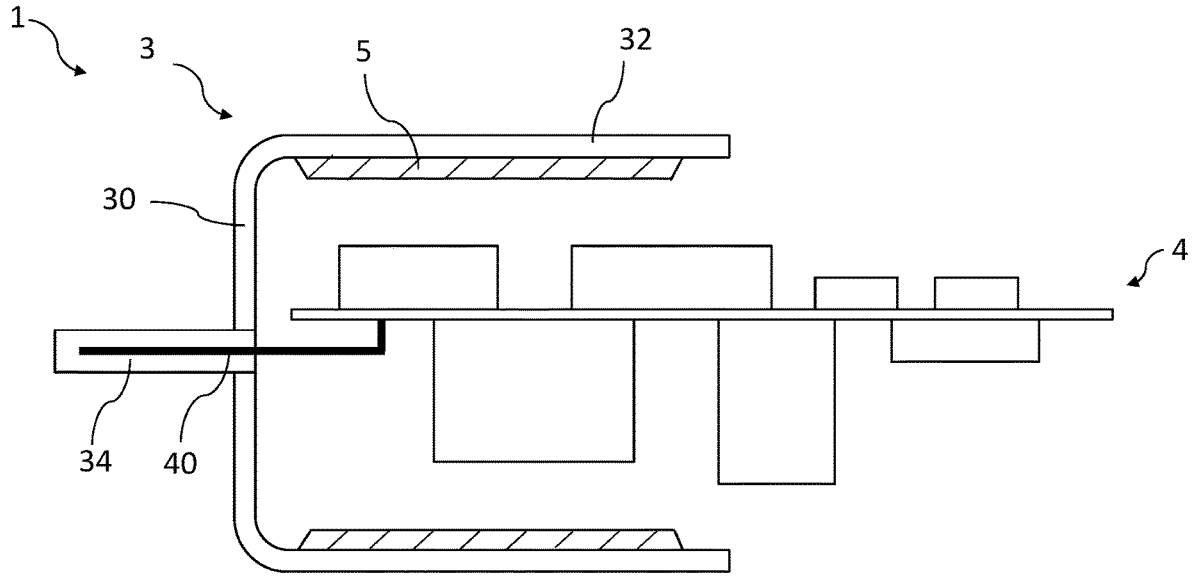
FIG. 2 shows schematically a side view of an end cap of the light fixture according to FIG. 1 before the assembly with a tube of the light fixture.
Figure 3:
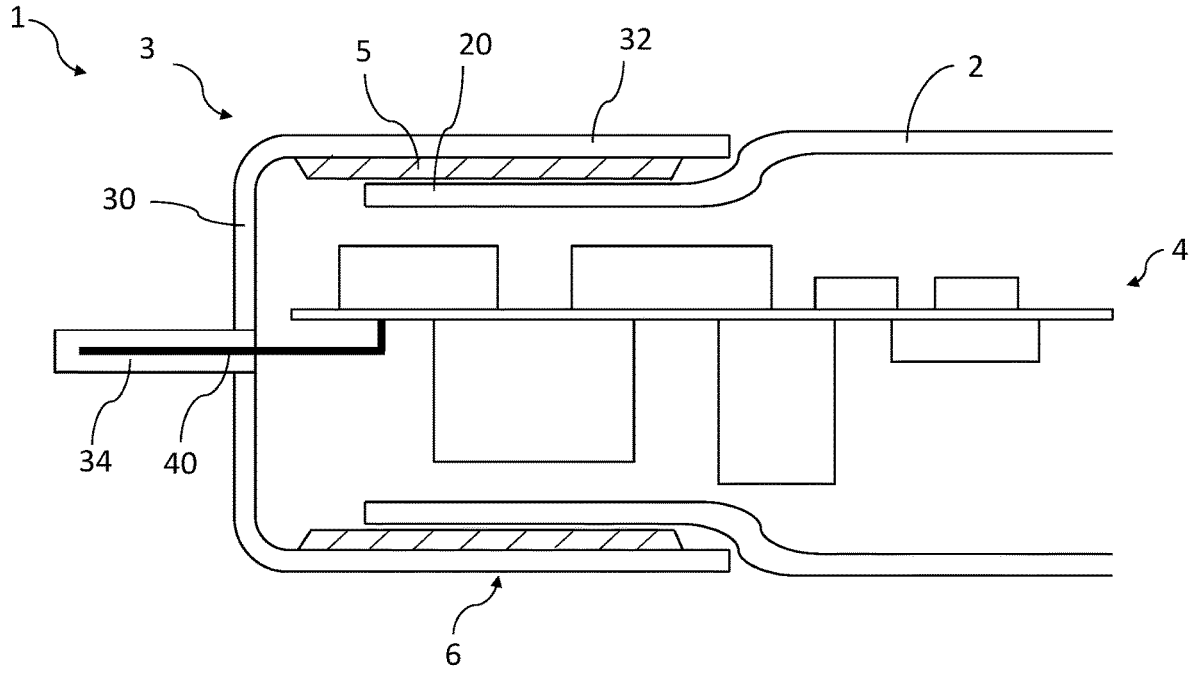
FIG. 3 shows schematically a side view of the light fixture according to FIG. 1 before the foaming of an adhesive.

FIG. 2 shows schematically a side view of the end cap 3 of the light fixture 1 according to FIG. 1 before the assembly with the tube 2.

In a first step the driver device 4 is inserted with its connecting wires 40 into contact pins 34 of the end cap 3 which extend outwards from an end face 30 of the end cap 3 and then the contact pins 34 and the connecting wires 40 introduced therein are crimped, so that an initial connection between the end cap 3 and the driver device 4 is achieved.

In a further embodiment (not shown) the driver device 4 can also be pre-fixed in another way to the end cap 3.

Next an expandable, in this case foamable, adhesive 5 is applied to the inner face of an annular collar 32 of the end cap 3, which later forms an overlap region 6 with the tube 2. The adhesive 5 is applied as a cohesive application in an annular or cylindrical shape along the collar 32.

Alternatively, the adhesive can first be applied to the end cap 3 and then the driver device 4 can be inserted in order in this way also to achieve a pre-fixing of the driver device 4.

Subsequently the driver device 4 is introduced into the light-permeable tube 2 and the end cap 3 with the collar 32 is pushed onto the tube 2. FIG. 3 shows schematically a sectional view of the light fixture 1 according to FIG. 1 before the foaming of the adhesive 5 and the overlap region 6 forms between the end cap 3 and the tube 2.

After the fitting of the end cap 3 onto the tube 2 heat is introduced, at least in the overlap region 6, into the adhesive 5 in a manner which is known per se, so that an expansion and preferably a foaming of the adhesive 5 takes place.

In this case, the adhesive 5 expands into the overlap region 6 and also into the interior of the light fixture 1 or the tube 2 and as a result additionally surrounds the driver device 4, as shown in FIG. 1, which illustrates the final state of the expanded adhesive after the foaming. Although the invention has been illustrated and described in greater detail by the depicted exemplary embodiments, the invention is not restricted thereto and other variations can be deduced therefrom by the person skilled in the art without departing from the scope of protection of the invention.

In general "a" or "an" may be understood as a single number or a plurality, in particular in the context of "at least one" or "one or more" etc., provided that this is not explicitly precluded, for example by the expression "precisely one" etc.

Also, when a number is given this may encompass precisely the stated number and also a conventional tolerance range, provided that this is not explicitly ruled out.

If applicable, all individual features which are set out in the exemplary embodiments can be combined with one another and/or exchanged for one another, without departing from the scope of the invention.

LIST OF REFERENCES

1 light fixture
2 tube
20 free end
3 end cap
30 end face
32 collar
34 contact pin
4 driver device
40 connecting wire
5 adhesive
6 overlap region

The invention claimed is:

1. A light fixture comprising:
a tube having light-permeable properties;
at least one end cap on a free end of the tube; and
a driver device connected to a light module arranged inside the tube, wherein the driver device is received at least partially in the tube and held in the tube by the end cap, wherein the end cap is fastened on the tube by an expanded adhesive, wherein the driver device is fastened by the expanded adhesive to the end cap or to the tube, wherein the driver device is in contact with the expanded adhesive.

2. The light fixture according to claim 1, wherein the driver device is at least partially surrounded by the same cohesive application of the expanded adhesive, which fastens the end cap on the tube, wherein the expanded adhesive extends into the tube.

3. The light fixture according to claim 1, wherein the expanded adhesive is a foamed, heat-cured cement.

4. The light fixture according to claim 1, wherein the expanded adhesive at least partially surrounds the driver device and at least partially fills a free space located between the tube and the driver device.

5. The light fixture according to claim 1, wherein the driver device is connected to contact pins extending outwards through the end cap for contacting a lamp socket and a light module driven by the driver device arranged inside the tube.

6. The light fixture according to claim 5, wherein the light module is a LED light module.

7. The light fixture according to claim 1, wherein the driver device is at least partially submerged in the expanded adhesive.

8. A method for producing a light fixture, the method comprising:
applying an expandable adhesive to an inner face of an annular overlap region of an end cap;
introducing a driver device at least partially into a tube;
fitting the annular overlap region of the end cap onto the tube; and
expanding the expandable adhesive on the end cap and the tube to fasten the driver device to the end cap or to the tube, wherein the driver device is in contact with the expanded adhesive.

9. The method according to claim 8, wherein the step of expanding the expandable adhesive produces a foam cladding that at least partially surrounds the driver device and thereby fastens the driver device to the end cap or to the tube.

10. The method according to claim 9, wherein the driver device is completely surrounded with the foam cladding.

11. The method according to claim 8, wherein the expanding step has the expandable adhesive at least partially filling a free space located between the tube and the driver device.

12. The method according to claim 8, further comprising triggering an expansion of the expandable adhesive by a heat input onto the expandable adhesive.

13. The method according to claim 12, wherein the step of expanding further comprises foaming.

14. The method according to claim 8, further comprising:
connecting the driver device to contact pins extending outwards from the end cap for contacting a lamp socket;
connecting wires of the driver device from an inner face of the end cap into a hollow of the contact pins formed on the inner face; and
crimping the wires of the driver device in the hollow of the contact pins.

15. The method according to claim 8, wherein the expandable adhesive is a foamed, heat-curing cement.

16. The method according to claim 8, wherein the driver device is at least partially submerged in the expanded adhesive.

17. The method according to claim 8, wherein the expanded adhesive extends into the tube.

* * * * *